United States Patent [19]

Silbernagel

[11] 4,219,179

[45] Aug. 26, 1980

[54] SIGN HOLDER

[76] Inventor: Hermann Silbernagel, Uhlandstrasse 7, 6800 Mannheim 1, Fed. Rep. of Germany

[21] Appl. No.: 900,516

[22] Filed: Apr. 27, 1978

[30] Foreign Application Priority Data

Mar. 13, 1978 [DE] Fed. Rep. of Germany ..... 7714523

[51] Int. Cl.[2] ..... A47F 7/00

[52] U.S. Cl. ..... 248/488; 40/606; 248/159; 248/172

[58] Field of Search ..... 248/466, 488, 172, 519, 248/520, 523, 346, 146, 148, 512, 513, 469, 165; 40/606, 607, 610, 612, 155

[56] References Cited

U.S. PATENT DOCUMENTS

| | | | |
|---|---|---|---|
| 1,359,492 | 11/1920 | Demuth | 248/469 |
| 2,497,760 | 2/1950 | Chambers | 40/155 |
| 3,171,626 | 3/1965 | Keats | 40/607 |
| 3,231,230 | 1/1966 | Mueller | 248/488 |
| 3,620,496 | 11/1971 | Bolt | 248/488 |
| 3,831,304 | 8/1974 | Miller | 40/607 |
| 3,847,335 | 11/1974 | Ross | 40/610 |

FOREIGN PATENT DOCUMENTS

| | | | |
|---|---|---|---|
| 638397 | 4/1962 | Italy | 248/488 |
| 283702 | 10/1952 | Switzerland | 248/469 |

*Primary Examiner*—Rodney H. Bonck
*Attorney, Agent, or Firm*—Staas & Halsey

[57] ABSTRACT

A sign holder, having upper and lower parts, for supporting temporarily located signs. The upper and lower parts are formed from one or more tubes which telescope into each other to allow the sign holder to support signs of varying sizes. Various cantilevers and further tubes or supports may be affixed to the sign holder to provide additional support and to enable the rapid erection and dissassembly of the sign holder.

14 Claims, 7 Drawing Figures

SIGN HOLDER

BACKGROUND OF THE INVENTION

1. Field of the Invention

The invention concerns a sign holder or support for holding temporarily located signs.

2. Description of the Prior Art

At building sites along traffic roads, particularly along public highways, a problem arises when temporary but adequate signs must be set up quickly at the building site in order to prevent accidents that could occur because of traffic difficulties occasioned by the building activities. The act of providing the site with signs must be executed quickly by the workman and it must effect the complete furnishing of the building site with signs within a short period of time, so that no unexpected traffic problems will be encountered by drivers even while the signs are being put up.

Again, the same problem arises in connection with the dismantling of the signs; they must be removed as quickly as possible, without the necessity of solving complicated problems connected with the separation of the various sign parts, and with the result that traffic difficulties do not arise during the dismantling process.

Partial and incomplete signs are confusing to the passing driver both during their erecting and dismantling and present a greater traffic hazard than when the building site is completely furnished with signs according to traffic regulations.

At present such temporary signboards are usually set up by screwing one or more wooden beams or posts to the back of a sign, whereby a good part of the post below the lower edge of the sign lies exposed and is knocked into the ground by a worker at the spot where the sign is to be set up. The disadvatages of setting up a sign in this way are that it can easily be toppled by winds or that as a result of the saturation of the ground due to rain, the wooden post is not solidly anchored and the sign is likely to collapse. Consequently there is the danger that after a sign falls down, the building site will be inadequately provided with signs, which may lead to accidents.

SUMMARY OF THE INVENTION

The present invention concerns a device for the securing of a sign, by means of which the sign can be attached quickly and simply to a holder. According to the invention, the sign holder or support consists of upper and lower parts, whereby the upper part and the lower part each consist of at least one tube or pipe and a perpendicular cross-bar with hooks. The hooks on the upper part are bent downward and the hooks on the lower part are bent upward. The lower part has the same number of tubes as the upper part, but the cross-sections of the tubes of the lower part are greater than the cross-sections of the tubes of the upper part, and the tubes of the lower part project beyond their cross-bar in both directions. The respective tubes of the upper and lower parts have the same cross-sectional shape, (e.g.—square or rectangular), to allow the telescopic insertion of one tube within another.

In a sign holder according to the present invention wherein the tube or tubes of the upper part can be inserted into the tube or tubes of the lower part, it is possible to alter the distance between the cross-bar of the upper part and the cross-bar of the lower part without the necessity of solving the screwing or coupling problem. The upper edge of the sign to be displayed by the sign holder is placed against or on the cross-bar of the upper part, and then the upper part is raised with the aid of the sign, (whereby the tube of the upper part slides within the tube of the lower part), until the lower edge of the sign can be brought behind the hooks of the cross-bar of the lower part. In this way the distance between the cross-bar of the upper part and the cross-bar of the lower part is adjustable so as to be equal to the distance between the upper edge and the lower edge of the sign. With a sign holder according to the present invention, it is consequently possible to put up a sign that is supported by the sign holder without screws or other fastenings. The sign can also be readily removed from the sign holder. The tube of the lower part extends downward before the cross-bar of the lower part, and the sign holder can be attached by means of this projecting part of the tube of the lower part to a suitable device which serves as a base for the erection of the sign holder.

In conformity with a preferred embodiment of the sign holder according to the invention, iron plates are soldered or welded to the cross-bars; these plates extend beyond the cross-bars in the directions in which the hooks of the respective cross-bar are bent. These iron plates serve to prevent a change in the position of the sign, which might be occasioned by a gust of wind, as the sign on the sign holder is allowed a certain free motion or play.

According to another embodiment of the present invention, additional tubes are welded to the tubes of the lower part. Extension tubes with a smaller cross-section can then be inserted into these additional tubes and are fixed in such a way that they project above the lower part. These extension tubes, which are attached to the lower part, serve to lengthen the lower part for the attachment of a very large sign in such a manner that it can be set up at a great distance from the ground with the help of the sign holder according to the present invention.

According to still another embodiment of the present invention, the lower part consists of a rectangle formed from at least two tubes and two perpendicular cross-bars, wherein the rectangle formed by the welding of these four parts is stabilized by several flat iron bars which are welded to the tubes and the cross-bars in such a way that a ladder-shaped arrangement develops within the rectangle. With this embodiment it is possible for the worker, after erecting the sign with the help of the sign holder according to the invention, to climb up on the back side of the sign to the upper edge of the sign by means of this ladder-shaped arrangement. The worker can then attach lights or similar arrangements without the necessity of bringing up a ladder and leaning it against the sign holder.

According to another preferred embodiment of the present invention, on two opposite sides of the part of the tubes projecting beyond the cross-bars of the lower part there are affixed holding devices that form the guides for cantilevers or brackets. These cantilevers comprise flat irons, welded together to form a triangle; one side of the triangle extends beyond its vertex and is formed into a hook. The application of this preferred embodiment makes it possible to secure the sign against a shift in its position, since the cantilevers affixed to the two opposite sides enlarge the standing surface of the sign holder and thereby secure it against collapse, especially in those cases where the sign holder serves to support a large sign.

According to another preferred embodiment of the present invention, a tube with a threaded hole is welded to the outer ends of each of the cantilevers. Into these tubes can be inserted additional tubes with a smaller cross-section. These additional tubes are closed on one side by means of an iron plate projecting on the edges to form feet. These feet can then be secured at any place along their length by means of a screw threaded through the threaded hole. In case the sign holder does not stand on a horizontal surface, it is necessary that the end points of the cantilevers have a changeable distance from the surface. This is achieved by inserting these feet into the tubes attached to the outer ends of the cantilevers. Since these feet traverse the distance between the ground surface and the outer end of the cantilevers and since this distance is variable, the length of these feet can be adjusted as required on the spot.

According to a further preferred embodiment, holding devices are provided on the lower part of the sign holder and on the cantilevers and these devices are used for securing the ends of adjustable length tubes. After the erection of the sign holder it is possible to secure the adjustable length tube or tubes to the holding device or devices and thus enable the erected sign holder to be stabilized and additionally secured against collapse.

An object of the invention is to provide a sign holder that a sign can be affixed to easily and quickly in the field without causing a protracted traffic hindrance necessitated by the application of screws and bolts or because of similar time-consuming work processes.

In the attached drawings embodiments of the invention are shown; these will be described in detail below.

DESCRIPTION OF THE PREFERRED EMBODIMENTS

Figure 1:
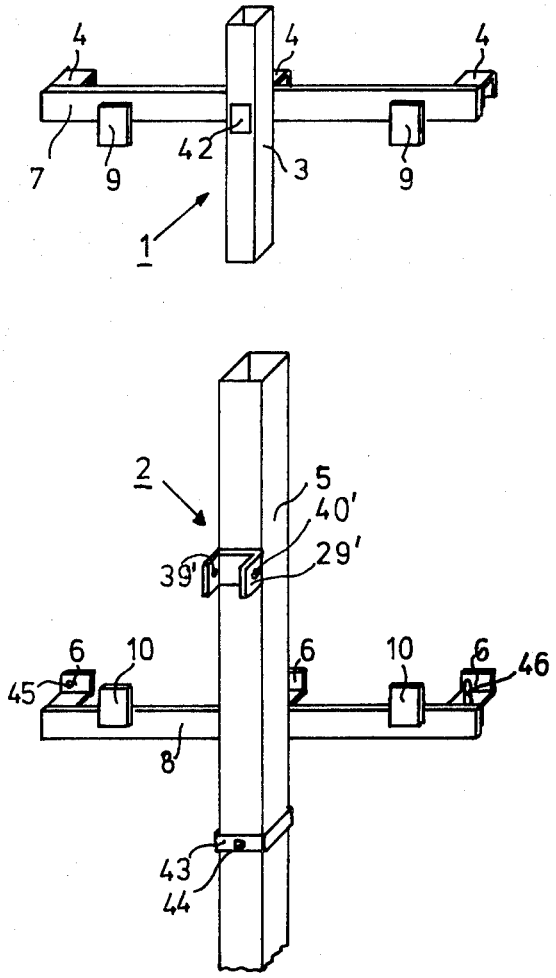
FIG. 1 shows a perspective view of a sign holder according to the invention.

FIG. 1 shows a sign holder consisting of an upper part 1 and a lower part 2. The upper part 1 consists of a square tube 3 and a cross-bar 7, to which three hooks 4 and two iron plates 9 have been welded. The lower part 2 consists of a square tube 5 and a cross-bar 8, to which three hooks 6 and two iron plates 10 have been welded. Of course angle irons or flat irons may be used instead of cross-bars. Square tube 3 has a smaller cross-section than square tube 5 and the drawing makes apparent that the lower end of square tube 3 can be inserted into the open upper end of square tube 5 and then slid downward through square tube 5 until cross-bar 7 of the upper part 1 rests on the upper end of square tube 5. After this has happened, (i.e., after square tube 3 has been inserted in square tube 5), a sign can be pushed from below with its upper edge inserted into hooks 4 of the upper part. Thereupon one can push the upper part of the sign holder upward with the upper edge of the sign, whereby square tube 3 slides upward in square tube 5. After the desired distance between cross-bar 7 of the upper part 1 and cross-bar 8 of the lower part 2 has been attained (this distance corresponding to the height of the sign), one inserts the lower edge of the sign onto hooks 6. The sign is thus attached to the sign holder illustrated in FIG. 1. The distance between cross-bar 7 and cross-bar 8 is equal to the height of the sign. Because of hooks 4 and 6, which are bent toward each other, the sign cannot fall forward, and because of the projecting iron plates 9 and 10, the sign cannot tilt backward. The lower end of square tube 5 is shown broken off in FIG. 1 to indicate that square tube 5 may extend beyond the lower edge of cross-bar 8 by any desired length. This projecting part of square tube 5 can be secured with a device that prevents a collapse of the sign holder. The sign holder illustrated to FIG. 1 is shown as a rear view (i.e., an inserted sign would be visible from the back side thereof).

In FIG. 1 an optional plate 42 is shown on the upper part 1. This iron plate 42 is welded to the side of square tube 3 opposite the cross-bar 7, so that the lower edge of this iron plate 42 is somewhat below the lower edge of cross-bar 7. The iron plate 42 acts as a buffer or stop when square tube 3 is inserted into square tube 5. Furthermore, when the sign is removed, the iron plate 42 prevents the blind-frame of the sign from being canted with the cleft or gap between square tubes 3 and 5.

Furthermore, FIG. 1 also shows an optional collar 43, which consists of a square tube with a greater cross-section than square tube 5 and which is present in the lower region of the square tube 5. This collar 43 is provided with a threaded hole 44, through which a screw can be threaded, and using this screw, collar 43 can be affixed to any desired place along one side of square tube 5.

FIG. 1 also shows an optional holding device 29', which is welded to one side of square tube 5. This holding device 29' is formed from a piece of iron rail with a U-shaped profile and has on the free or open sides of the U-shaped profile threaded holes 39' and 40', which lie opposite each other. This holding device 29' serves in the same way as holding device 29 illustrated in FIG. 3 and is used for the attachment of so-called wind struts. These wind struts and their employment will be described in detail in connection with the description of FIGS. 3 and 5. For this reason they will not be discussed at this point.

Furthermore, bolts or pins may be welded to cross-bars 7 and/or 8, and one bolt 46 is illustrated on the lower part 2. The bolts 46, however, may also be provided on the upper part 1. These bolts or pins 46 serve to secure the sign attached to the sign holder, whereby a corresponding opening must be made in the blind frame of the sign. When the sign is attached to the sign holder, this opening in the blind frame of the sign is connected with the bolts on cross-bars 7 and/or 8. This guarantees that the attached sign is secure against shifting.

Another design feature to prevent the shifting of the sign is shown in FIG. 1. A threaded hole 45, which can be seen on FIG. 1 on the left hook 6 of the lower part 2, has been drilled through the vertical part of hook 6. Such threaded holes 45 may also be provided on all hooks 6 of the lower part 2 and all hooks 4 of the upper part 1. These threaded holes 45 are used to receive screws by means of which the sign can be held in position behind hooks 4 or 6 under pressure on the sign holder. This device, which may be aided by bolts or pins 46, secures the sign against shifting or sliding because of a gust of wind.

Figure 2:
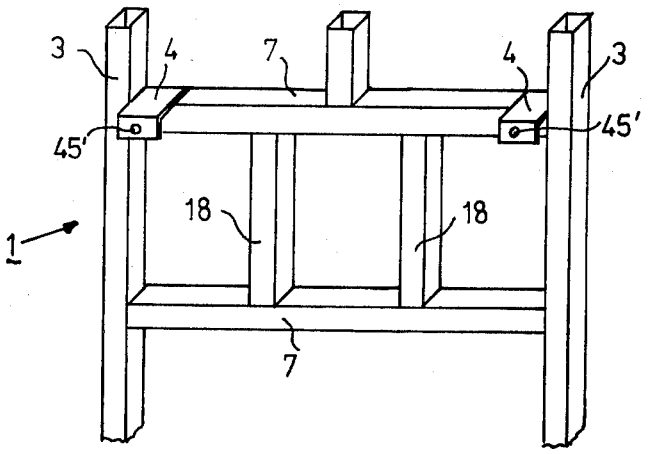
FIG. 2 shows a perspective view of a particularly preferred embodiment of the upper part of a sign holder according to the invention.

In contrast, FIG. 2 shows the front side of the upper part of a preferred embodiment of a sign holder in accordance with the present invention. According to this embodiment—as shown in FIG. 2—the upper part consists of two vertical square tubes 3, which are connected to each other by two cross-bars 7. To stabilize the resultant rectangle, square tubes 18 have been welded between the two cross-bars 7. The upper cross-bar 7 shows hooks 4, which serve to receive the upper edge of a sign, as has been explained in the description of FIG. 1.

Figure 3:
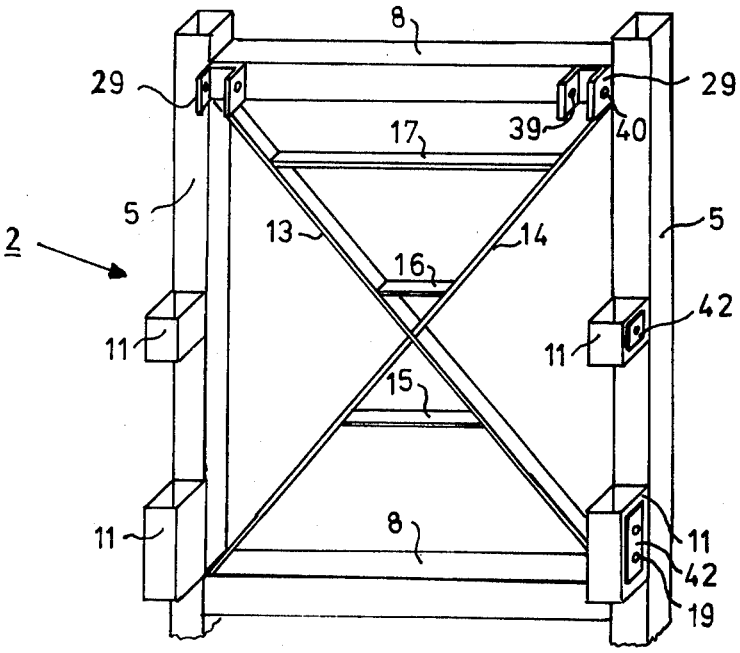
FIG. 3 shows a perspective view of a particularly preferred embodiment of the lower part of a sign holder.

FIG. 3 illustrates a rear view of the lower part of a preferred embodiment of a sign holder in accordance with the present invention. The lower part consists of two square tubes 5 which are connected by two cross-bars 8. The resultant rectangle is stabilized by means of several flat-iron bars 13, 14, 15, 16, and 17. These flat-iron bars have been arranged in such a way that bars 15, 16, and 17 are placed horizontally and, together with cross-bars 8, provided a ladder-like arrangement. Accordingly, a worker can climb up this ladder-shaped arrangement to the upper end of the lower part 2. The upper part illustrated in FIG. 2 and the lower part illustrated in FIG. 3 together provide a sign holder according th the present invention. In such a sign holder, square tubes 3 are inserted into square tubes 5. Attention, however, is directed to the fact that the upper part in FIG. 2 must be turned 180°, since FIG. 2 illustrates the front view of the upper part, whereas FIG. 3 illustrates the rear view of the lower part. The cross-section of the square tubes 5 is greater than that of the square tubes 3, in order to guarantee the satisfactory sliding of square tubes 3 into square tubes 5. Furthermore, square tubes 3 can be extended by tubes (not shown in the drawings) having a circular cross-section, and the upper part 1 can slide into square tubes 5 with the help of these circular tubes. Hooks 6 on the front side of the lower cross-bar 8 are not visible in FIG. 3. Hooks 4 on the cross-bar 7 of the upper part 1, as shown in FIG. 2, have threaded holes 45', which are used for the reception of screws as in the case of the threaded holes 45 in FIG. 1. These screws are also used as a securing device for the sign. Such threaded holes 45 are also present in the not visible hooks 6 of the lower part according to FIG. 3. Their mode of action has been explained in the description of FIG. 1. There may also be bolts or pins on cross-bar 7 and/or 8 which can be inserted into the openings in the blind frames of a sign. These pins serve the same purpose as the pin 46 shown and described in FIG. 1.

Figure 4:
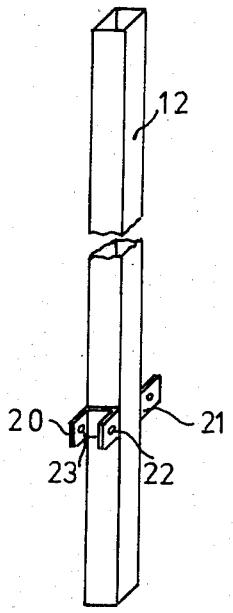
FIG. 4 shows a perspective view of a square tube that serves the lengthening of the lower part according to FIG. 3.
Figure 7:
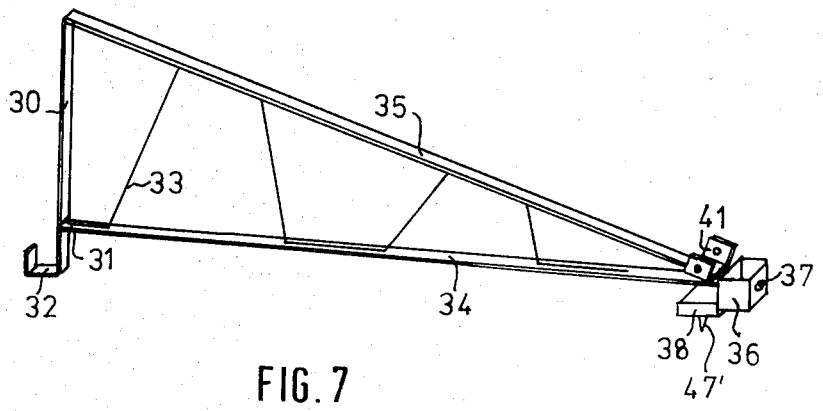
FIG. 7 shows a perspective view of a cantilever, which can serve the further stabilization of the sign holder according to FIGS. 3 and 4.

FIG. 4 shows a square tube 12, which can be inserted into square tubes 11 illustrated in FIG. 3, and these square tubes 11 are welded to square tubes 5, as shown in FIG. 3. Square tubes 11 disclose iron plates 42, which have been supplied with threaded holes 19. If one threads a screw through this threaded hole 19, one can attach square tube 12, which is present in square tubes 11, with the help of this screw, at any place along one side of square tube 12. Accordingly, square tube 12 can project downward beyond cross-bar 8 of the lower part as far as desired, as shown in FIG. 3, and thus a prolongation of the lower part can be effected. Square tube 12 may have any length desired. Furthermore, as illustrated in FIG. 4, square tube 12 has holding devices 20 and 21, consisting of pieces of iron rail with U-shaped profiles, which have been welded to the opposite sides of square tube 12. These holding devices 20 and 21 form guides for cantilevers. An example of such a cantilever is shown in FIG. 7. This cantilever consists of one or more flat irons, angle irons or iron rails with a U-shaped profile. These iron rails are welded in such a manner that they form a triangle with sides 30, 35, and 34. Side 30 of the triangle extends beyond point 31 and forms hook 32. For stabilizing the triangle, a number of iron rods 33 are welded to the two sides 34 and 35 of the triangle. At the point of the triangle formed by the two sides 34 and 35, there is a square tube 36, which is provided with a threaded hole 37. An iron plate 38 is welded to side 34. This iron plate is advantageously provided with a rounded or pointed pin 47', the purpose of which is to affix the end of the cantilever securely to the ground underneath when the entire assembly is used in the erection of a sign holder in accordance with the present invention.

The cantilever shown in FIG. 7 is placed with its side 30 against the side of the square tube 12 having the holding device 20 as shown in FIG. 4. When the cantilever is placed on this side of the square tube 12, hook 32 is pushed into square tube 12 from below, and it interlocks with the latter. It should be noted that side 30 is located in the U-shaped profile of holding device 20. In this way a toppling over or shifting of the cantilever shown in FIG. 7 is avoided. It is advantageous to provide the holding devices with boreholes. These boreholes are shown as the two openings 22 and 23 on the free or open sides of the U-shaped profile of holding device 20 of FIG. 4; these openings 22 and 23 lie opposite each other. If a cantilever is located at the square tube and in the U-shaped profile of holding device 20, a peg or pin can be pushed through openings 22 and 23 to prevent the cantilever from changing its position.

At the outer end of the cantilever illustrated in FIG. 7 an iron plate 38 is shown welded to the bottom. This plate 28 serves as the basal surface of the cantilever at its outer point. This basal surface 38 should be somewhat larger than the basal surface which is formed by the outer end of side 34. According to one embodiment of the present invention, located at the outer end of the cantilever formed by the point of sides 35 and 34 is a square tube 36 with a threaded hole 37. Into this square tube a foot—as shown in FIG. 6—can be inserted from below if the cross-section of square tube 24 of the foot according to FIG. 6 is smaller than the cross-section of square tube 36.

Figure 6:
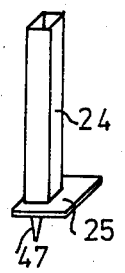
FIG. 6 shows a square tube with a welded-on iron plate that serves as a foot capable of being inserted.

FIG. 6 shows a square tube 24 which is closed on one side with an iron plate 25 that projects from the tube along the edges. This square tube 24 has a smaller cross-section that the square tube 36 shown in FIG. 7. After the foot illustrated in FIG. 6 has been inserted into square tube 36 illustrated in FIG. 7, square tube 24 can be secured at any desirable position on one side by means of a screw that is threaded through threaded hole 37. Accordingly, the length of square tube 26 projecting downward through square tube 36 can be chosen at will. When a sign holder using the cantilevers shown in FIG. 7 is not set up on a level or even surface, the sign holder can nevertheless be erected vertically, since the inserted foot with its variable length can be used to adjust the distance between the end of the cantilever and the ground surface. As shown in FIG. 6, it is desirable to have a pointed or round pin or peg 47 on the iron plate 25 to serve to anchor the foot securely to the ground surface below.

Figure 5:
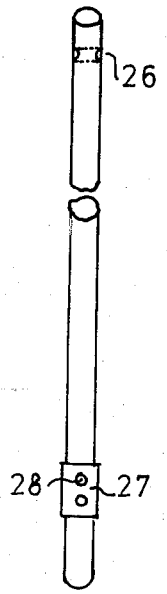
FIG. 5 shows a tube that serves the stabilization of the sign holder according to a preferring embodiment

FIG. 5 shows a round or circular tube, which may have any desired length. This tube has a borehole 26 at one end. On the other end of the tube an iron plate 27 with threaded holes 28 has been welded. The tube shown in FIG. 5 can be affixed to the upper cross-bar 8 of the lower part shown in FIG. 3 by the end of the tube that has the borehole 26. The upper cross-bar 8 has holding devices 29, which are formed from pieces of iron rails with U-shaped profiles. These holding devices 29 have boreholes 39 and 40 on the free sides of their U-shaped profile and these boreholes lie opposite each other. If the end of the tube shown in FIG. 5 is inserted in the U-shaped profile of the holding device 29, a peg or pin can be pushed through boreholes 39, 26, and 40. In this way the end of the tube with borehole 26 is secured to the lower part as shown in FIG. 3. If, however, one employs a similar tube as the one shown in FIG. 5, but without iron plate 27 and with a smaller cross-section than that of the tube shown in FIG. 5, then this tube can be secured in the same way to the holding device 41 present at the outer end of the cantilever shown in FIG. 7. If the cantilever shown in FIG. 7 is attached to a sign holder and a tube as shown in FIG. 5 has been secured to a lower part 2 using one of the holding devices 29, then one can insert the tube affixed to holding device 41 of the cantilever shown in FIG. 7 into the tube affixed to the lower part 2 providing that the first tube has a smaller diameter than that of the second tube. One can then secure the tube by means of a screw which is screwed into the threaded hole 28 in the iron plate 27 on the tube. In this way the erected sign holder together with the cantilever is stabilized by the tube shown in FIG. 5 and the described, but not illustrated additional tube. These two tubes together have the effect of a so-called "wind-strut," as the two described tubes act as a support and protect the sign holder against collapse due to a gust of wind. As has been described, one tube fits into the other, and by means of the holding screw 28, they can be easily secured, so that the distance between the upper and the lower end of this wind strut can be varied at will.

It is to be understood that while the described embodiments utilize tubes having only square and circular cross-sections, the use of tubes having such cross-sections i merely for exemplary purposes and the invention is clearly not limited to tubes of those specific cross-sections. Furthermore, the elements of the sign holder have been, for illustrative purposes only, described as being of iron. It is understood that other metals, (e.g.—aluminum, steel, etc.), or nonmetals, (e.g.—fiberglass), could also be utilized.

I claim:

1. A sign holder comprising: an upper and a lower part, the upper and the lower part each comprising at least one square tube and at least one perpendicular crossbar with hooks, said hooks bent downward on the upper part and upward on the lower part, the lower part having the same number of square tubes as the upper part, each of said at least one square tube of the lower part having a greater cross-section than the cross-section of its respective square tube of the upper part, and each of the at least one square tube of the lower part extending beyond its respective at least one crossbar in both directions; and further comprising a plurality of iron plates welded to at least one of said crossbars on each of said upper and lower parts, each of said plurality of plates projecting beyond its respective crossbar in the direction in which the hooks on its respective crossbar is bent.

2. A sign holder according to claim 1, further comprising at least one first additional square tube welded to each of the at least one square tube of the lower part, and at least one second additional square tube for each first additional square tube with a smaller cross-section then said first additional square tube, each second additional square tube inserted and secured within its respective first additional square tube to extend beyond the lower part.

3. A sign holder according to claim 2, wherein the lower part comprises at least two square tubes and two crossbars, and wherein the rectangle formed by said tubes and crossbars is stabilized by a plurality of flat iron bars welded to the square tubes and the crossbars in a ladder-shaped arrangement within said rectangle.

4. A sign holder according to claim 3, further comprising a plurality of cantilevers and holding devices, wherein, on each of two opposite sides of the part of the at least one square tube extending beyond the at least one crossbar of the lower part, one of said plurality of holding devices is affixed for forming guides for said plurality of cantilevers; said cantilevers being formed from flat iron rods welded into a triangular shape with one side of each cantilever extending beyond one vertex and terminating in a hook.

5. A sign holder according to claim 4 further comprising a third additional square tube with a theaded hole, said third additional square tube welded to the outer end of each of said plurality of cantilevers.

6. A sign holder according to claim 5, further comprising a plurality of variable length tubes and a plurality of holding devices, wherein said holding devices secure the ends of said plurality of variable length tubes, said plurality of variable length tubes and holding devices provided at the lower part of the sign holder and at each of the plurality of cantilevers for the stabilization of the sign holder.

7. A sign holder according to claim 1, wherein the lower part comprises at least two square tubes and two crossbars, and wherein the rectangle formed by said tubes and crossbars is stabilized by a plurality of flat iron bars welded to the square tubes and the crossbars in a ladder-shaped arrangement within said rectangle.

8. A sign holder according to claim 1, further comprising a plurality of cantilevers and holding devices, wherein, on each of two opposite sides of the part of the at least one square tube extending beyond the at least one crossbar of the lower part, one of said plurality of holding devices is affixed for forming guides for said plurality of cantilevers; said cantilevers being formed from flat iron rods welded into a triangular shape with one side of each cantilever extending beyond one vertex and terminating in a hook.

9. A sign holder comprising an upper and a lower part;

each of said upper and lower parts comprising at least one tube and at least one crossbar;

each of said at least one crossbars positioned perpendicular to its respective at least one tube and at least one of said at least one crossbars of each part having a plurality of hooks;

said lower part having the same number of tubes as said upper part, each of said at least one tube of said upper part telescoped inside its respective said at least one tube of said lower part; each of said at least one tube extending on either side of its respective at least one crossbar, each of said plurality of hooks on said upper part bent toward said lower part and each of said plurality of hooks on said lower part bent toward said upper part; and further comprising a plurality of plates affixed to at least one of said crossbars on each of said upper and lower parts, each plate projecting beyond its respective crossbar in the direction in which the hooks on its respective crossbar are bent.

10. A sign holder as in claim 9, further comprising at least one additional tube affixed to each of the at least one tube of the lower part, and at least one second additional tube for each first additional tube with a smaller crossection than said first additional tube, each second additional tube inserted and secured within its respective first additional tube to extend beyond the lower part.

11. A sign holder as in claim 10, wherein the lower part comprises at least two tubes and two crossbars, and wherein the rectangle formed by said tubes and crossbars is stabilized by a plurality of bars affixed to said tubes and crossbars in a ladder shaped arrangement within said rectangle.

12. A sign holder as in claim 11, further comprising a plurality of cantilevers and holding devices, wherein, on each of two opposite sides of the part of said at least one tube extending beyond the at least one crossbar of the lower part, one of said plurality of cantilevers, said cantilevers being formed from rods connected into a triangle shape with one side of each cantilever extending beyond one vertex and terminating in a hook.

13. A sign holder as in claim 12, further comprising a third additional tube with a threaded hole affixed to the outer end of each of said plurality of cantilevers.

14. A sign holder as in claim 13, further comprising a plurality of variable length tubes and a plurality of holding devices, wherein said holding devices secure the ends of said plurality of variable length tubes, said plurality of variable length tubes and holding devices provided at the lower part of the sign holder and at each of the plurality of cantilevers for stabilization of the sign holder.

* * * * *